United States Patent [19]

Bunch, Jr.

[11] Patent Number: 4,622,028

[45] Date of Patent: Nov. 11, 1986

[54] DELIVERY MECHANISM FOR PAPER SHEET PROCESSING APPARATUS

[76] Inventor: Ernest B. Bunch, Jr., 9619 N. 21st Dr., Phoenix, Ariz. 85021

[21] Appl. No.: 677,996

[22] Filed: Dec. 4, 1984

Related U.S. Application Data

[63] Continuation of Ser. No. 148,716, May 12, 1980, abandoned.

[51] Int. Cl.[4] ..... B65H 45/105; B65H 45/107

[52] U.S. Cl. ..... 493/413; 493/411; 226/97

[58] Field of Search ..... 493/411, 413, 414, 418; 226/97

[56] References Cited

U.S. PATENT DOCUMENTS

| | | | |
|---|---|---|---|
| 2,016,539 | 10/1935 | Brenn | 493/418 |
| 2,098,427 | 11/1937 | Menschner | 493/406 |
| 2,621,927 | 12/1952 | Swift | 493/10 |
| 3,464,610 | 9/1969 | Konig | 493/411 |
| 3,711,085 | 1/1973 | Bunch, Jr. | 493/419 |
| 4,053,151 | 10/1977 | Frezza | 493/415 |
| 4,095,779 | 6/1978 | Imagi et al. | 493/412 |
| 4,401,428 | 8/1983 | Thomas et al. | 493/415 |
| 4,494,948 | 1/1985 | Teyssier, Jr. | 493/11 |

FOREIGN PATENT DOCUMENTS

| | | | |
|---|---|---|---|
| 156727 | 12/1979 | Japan | 493/411 |
| 044421 | 3/1980 | Japan | 493/411 |
| 294662 | 4/1965 | Netherlands | 493/411 |

*Primary Examiner*—Francis S. Husar
*Assistant Examiner*—William E. Terrell
*Attorney, Agent, or Firm*—Drummond & Nissle

[57] ABSTRACT

An improved continuous form stationery folding machine. The continuous form stationery machine folds a strip of paper on transverse lines of weakening formed therealong and includes a mechanism for alternately distributing successive lines of weakening in the paper in opposite directions, a roller for continuously dispensing the strip of paper into the distributing mechanism, and mechanisms for receiving and folding paper issuing from the distributing mechanism. The improvement consists of apparatus for contacting the strip of paper dispensed by the roller with at least one airstream flowing in the general direction of travel of the paper.

1 Claim, 9 Drawing Figures

FIG-1
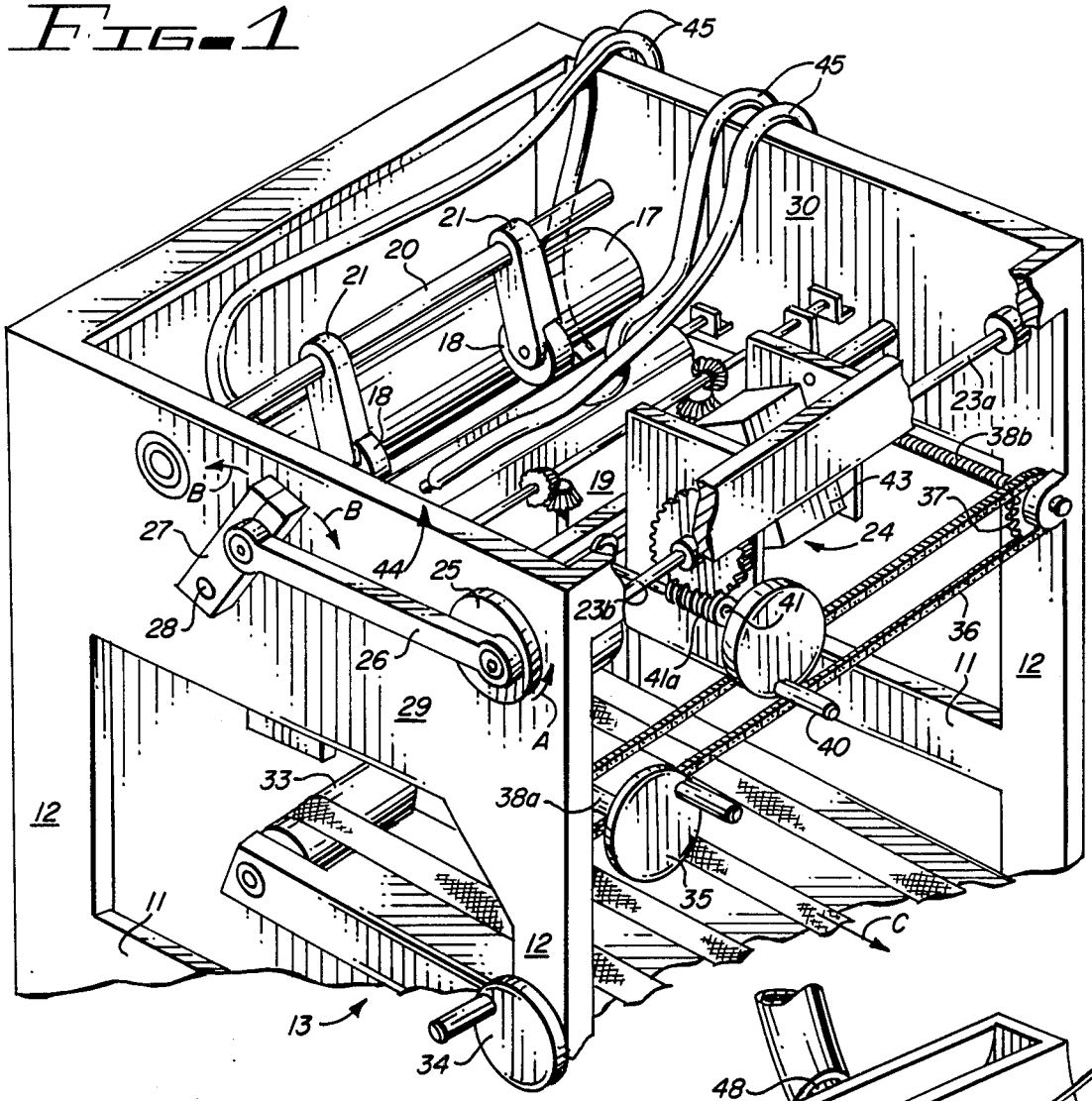
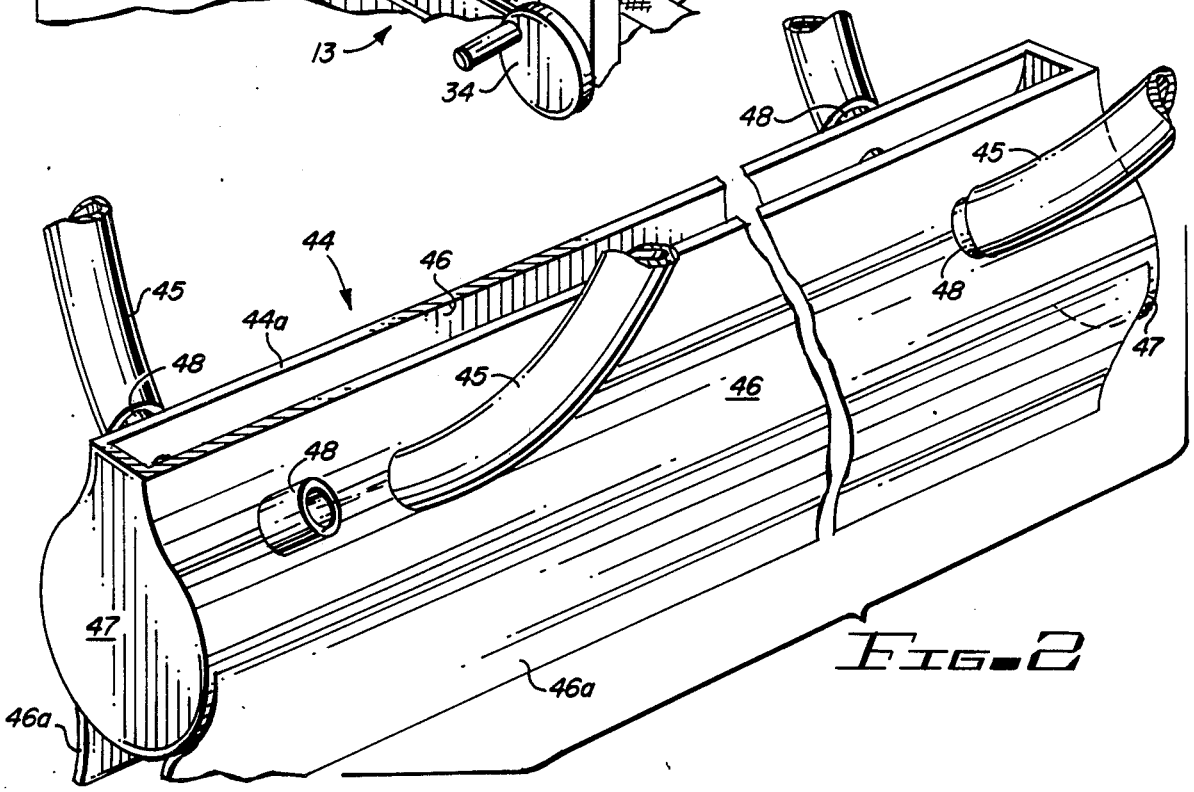
FIG-2

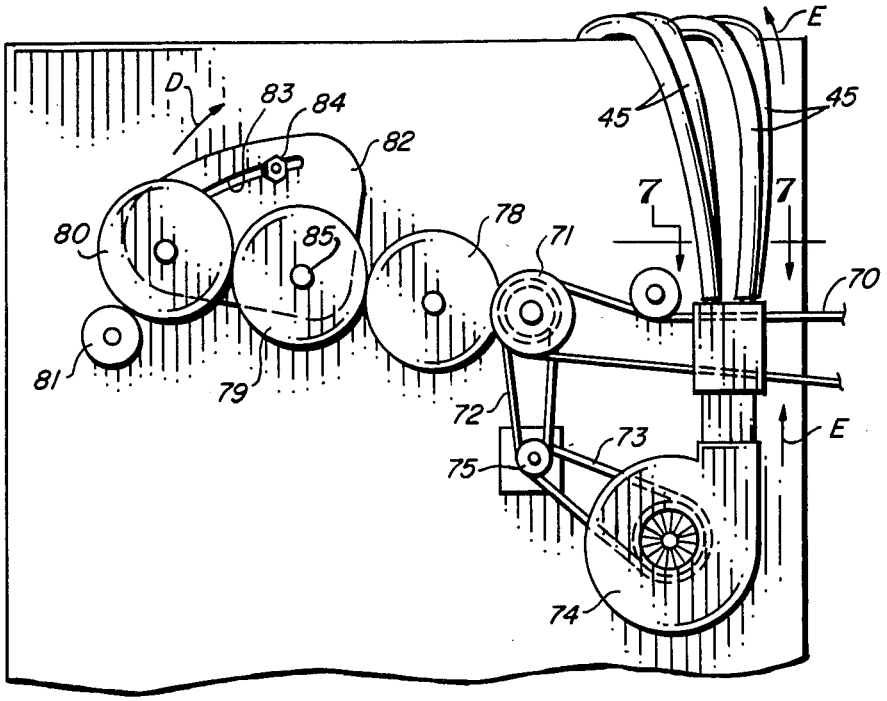
FIG. 6
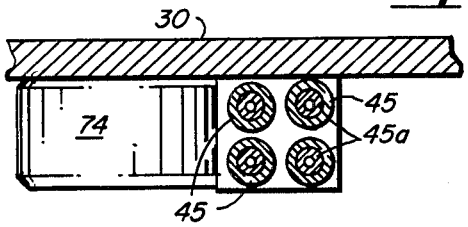
FIG. 7
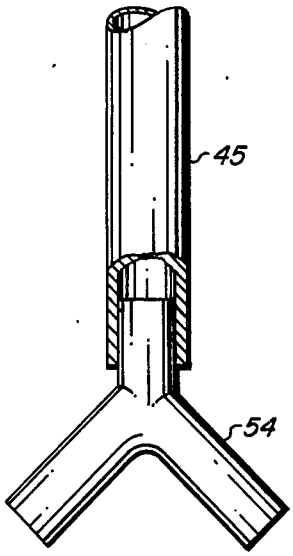
FIG. 9
FIG. 8
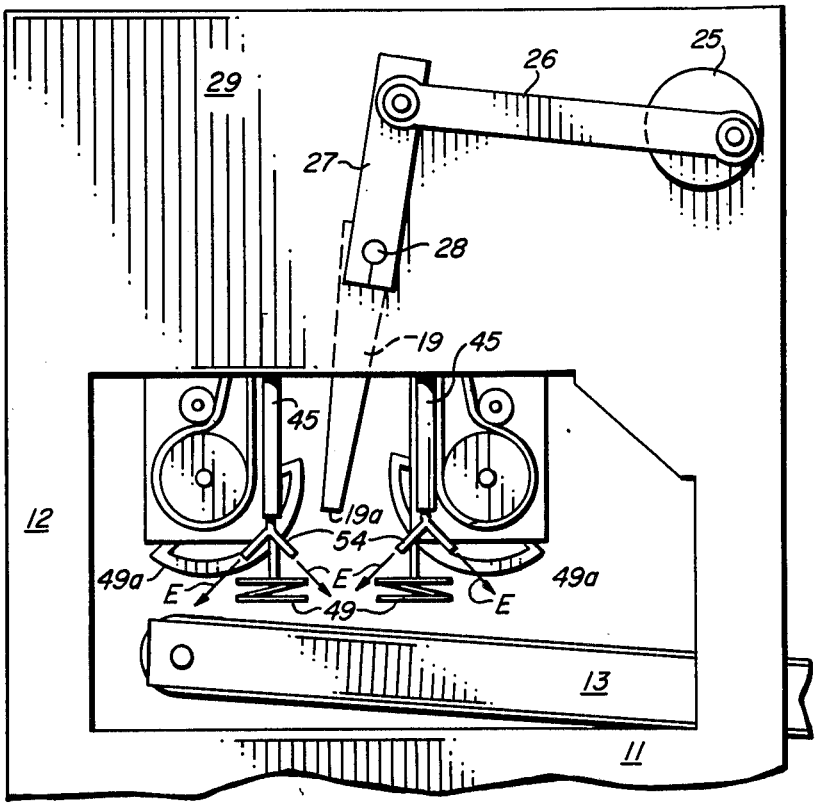

DELIVERY MECHANISM FOR PAPER SHEET PROCESSING APPARATUS

This application is a continuation of application Ser. No. 148,716, filed May 12, 1980, for Air Stream Apparatus for Continuous Form Statinonary Folding Machine, now abandoned.

This invention relates to improved apparatus for producing continuous form stationery by folding a strip of paper along transverse lines of weakening formed therealong.

More particularly, the invention concerns an improved stationery folding machine of the type having a mechanism which distributes successive lines of weakening formed in a strip of paper in substantially opposite directions, and having additional mechanisms for folding the paper along the lines of weakening to produce continuous form stationery.

Even more specifically the invention concerns an improved paper folding machine having a distributing mechanism, accompanying paper folding mechanisms, and a roller mechanism for feeding the incoming strip of paper into the distributing and paper folding mechanisms.

In a further respect the instant invention concerns an improved paper folding machine having apparatus for contacting paper with auxiliary air flow after the paper has been dispensed by said roller mechanism.

In a further and more specific respect, the invention concerns an improved paper folding machine of the general types disclosed in issued U.S. Pat. Nos 2,098,427 to Menschner, 3,086,768 to Lach, 3,352,553 to Preston and 3,711,085 to Bunch, Jr., having apparatus for directing at least one airstream in the same general direction of travel of paper dispensed by the roller mechanism.

In another respect, the invention concerns an improved paper folding machine of the type described having apparatus for contacting paper dispensed from the roller mechanism with air flow which functions to permit the machine to be utilized at higher operational speeds.

In still another respect, the invention relates to an improved paper folding machine of the type described having airstream apparatus which increases the efficiency of operation of the distributing and folding mechanisms and reduces the likelihood paper being folded at high operational speeds will be damaged.

The two general types of continuous form paper folding machines described in U.S. Pat. Nos. 2,098,427 to Menschner, 3,086,768 to Lach, 3,352,553 to Preston, and 3,711,085 to Bunch, Jr. have achieved fairly wide commercial acceptance in the market. These "continuous belt" and "oscillating chute" paper folding machines include a mechanism for distributing successive lines of weakening formed in a strip of paper in substantially opposite directions, rollers for continuously providing the dispensing mechanism with paper, and folding mechanisms for creasing paper dispensed by the distributing mechanism.

Each of these machines has a maximum operational speed. When the paper folding machines are operated above these speeds, the strip of paper may not be creased at the proper place and may tear or otherwise be fouled in the machine. A variety of factors limits the maximum operational speed attainable by a particular paper folding machine. One such factor is the elastic distortion folding or distributing mechanism members may undergo at high operational speeds. This phenomenon occurs in the operation of the chute on a "spiral" folding machine. Since the chute must oscillate back and forth, each change in direction requires the chute to decelerate, stop and accelerate in the opposite direction. At maximum operational speeds, this deceleration and change in direction occurs during a relatively short time span and the mouth of the chute, which distributes the incoming strip of paper and therefore has a normally linear opening therein, tends to be distorted or bent so that the flow of paper through the chute is slowed.

Under normal operating conditions, proper feed of the paper is maintained when the chute is in the midpoint of its swing from one extreme to the other since the paper is held by the spirals behind and to the sides of the chute and is pulled out of the chute as it swings away from the spirals. Thus, as the chute decelerates and stops before moving in the opposite direction, the paper goes slack since there is nothing pulling it from the chute at that point and paper passing through or exiting the chute at each extreme of its travel tends to form a loop or "bubble" due to the extra slack provided in the web. During the next swing of the chute, the sudden restoration of tension in the paper may cause the paper to be torn on a cross perforation or be creased at a position on either side of the perforation. Distortion of the chute at high speeds aggravates this problem.

In addition, at greater operational speeds, the crease or leading edge of the folded paper is "thrown" against the paper stops by the chute with greater force, sometimes causing the crease to be crumpled or wrinkled at the points where it contacts the paper stops. The folded paper also has a tendency not to properly compact for transportation away from the folding mechanism by the conveyor.

Accordingly, it would be highly desirable to provide improvements in paper folding machines of the type generally described in U.S. Pat. Nos. 2,098,427 to Menschner, 3,086,768 to Lach, 3,352,553 to Preston and 3,711,085 to Bunch, Jr. which would permit the machines to be utilized at higher operational speeds and which would minimize the probability of paper being damaged during the folding thereof.

Therefore, it is the principal object of the present invention to provide improvements in the general types of paper folding machines described in U.S. Pat. Nos. 2,098,427 to Menschner, 3,086,768 to Lach, 3,352,553 to Preston and 3,711,085 to Bunch, Jr. which would permit the machines to be utilized at higher operational speeds.

Another principal object of the present invention is to provide a mechanism for assisting the flow of paper through the distributing and folding mechanisms of continuous form paper folding machines of the types described.

Yet another object of the instant invention is the provision of improved continuous paper folding machines having improved mechanisms for distributing and folding the paper which minimizes the likelihood of the paper being damaged during folding thereof.

A further object of the invention is to provide an improved continuous form paper folding machine with airstream apparatus which facilitates the compacting of paper webbing by the distributing and folding mechanisms thereof.

These and other further and more specific objectives and advantages of the invention will be apparent to those skilled in the art from the following detailed description and the drawings.

For the purpose of illustrating the invention, the detailed description set forth below and in the drawings depicts the invention as employed in a specific type of "oscillating chute" paper folding machine, a "spiral" paper folding machine. However, as will be apparent to those skilled in the art, the airstream apparatus described as being included in a spiral paper folding machine will be similarly applicable in any other type of paper folding machine—including those described in U.S. Pat. Nos. 2,098,427 to Menschner, 3,086,768 to Lach, 3,352,553 to Preston and 3,711,085 to Bunch, Jr.—in which assisting the travel of paper being folded therein would improve operational efficiency of the machine.

FIG. 1 is a perspective view of an improved spiral paper folding machine which includes the presently preferred embodiment of the airstream apparatus of the invention;

FIG. 2 is a perspective view of a portion of the spiral folding machine of FIG. 1 illustrating further details of the airstream mechanism thereof;

FIG. 6 is a partial view of the right hand side of the paper folding machine of FIG. 1 illustrating the drive means which activates the paper dispensing roller and the impellor and further transmits motive power to that portion of the gear train activating the paper folding and distributing mechanisms;

FIG. 7 is a top sectional view taken along line 7—7 of FIG. 6, showing further details of the impellor thereof;

FIG. 8 is a side view of the spiral paper folding machine of FIG. 1 constructed in accordance with another embodiment of the invention; and FIG. 9 is a side sectional view of a portion of the airstream apparatus of the spiral paper folding machine of FIG. 8.

Figure 3:
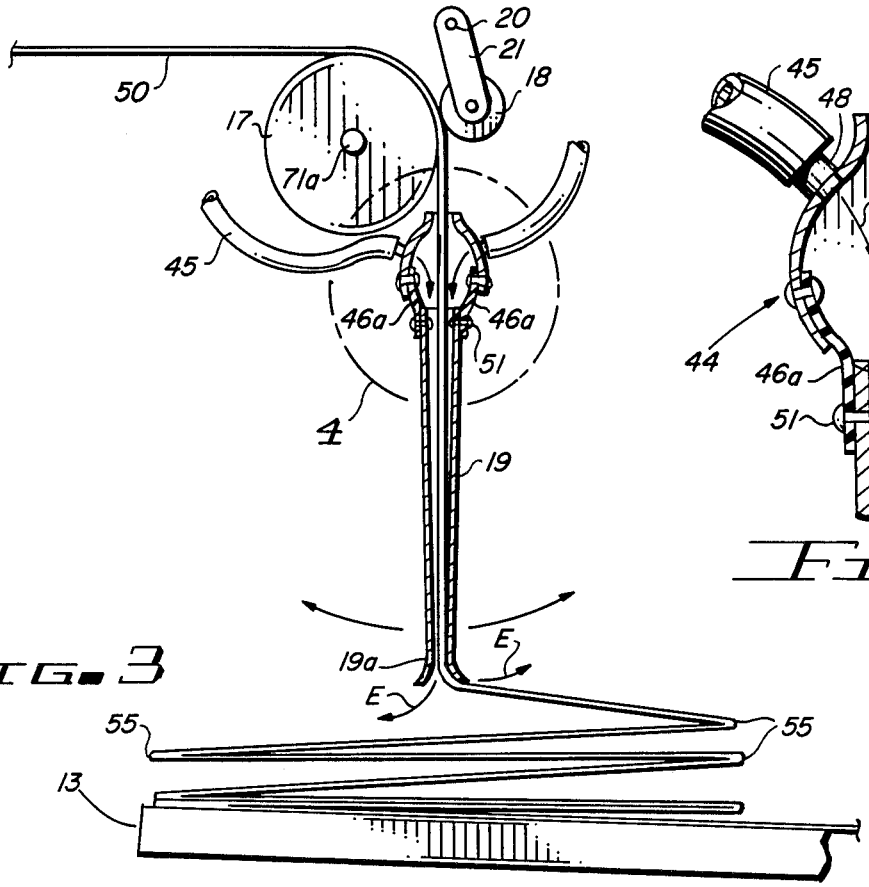
FIG. 3 is a schematic view of a portion of the spiral paper folding machine of FIG. 1 showing the inter-relationship between the paper distribution and airstream mechanisms thereof.
Figure 4:
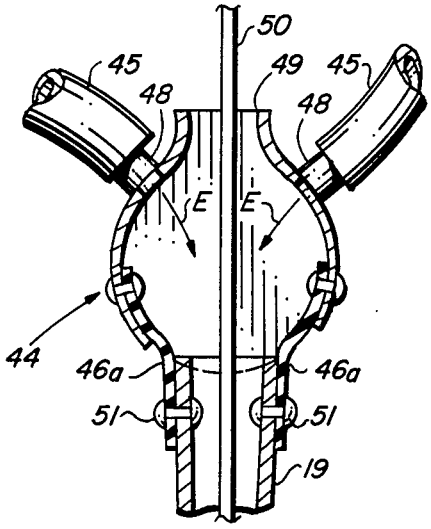
FIG. 4 is an enlarged view, partially in section, of the distributing and airstream mechanisms of FIG. 3 illustrating further details thereof.
Figure 5:
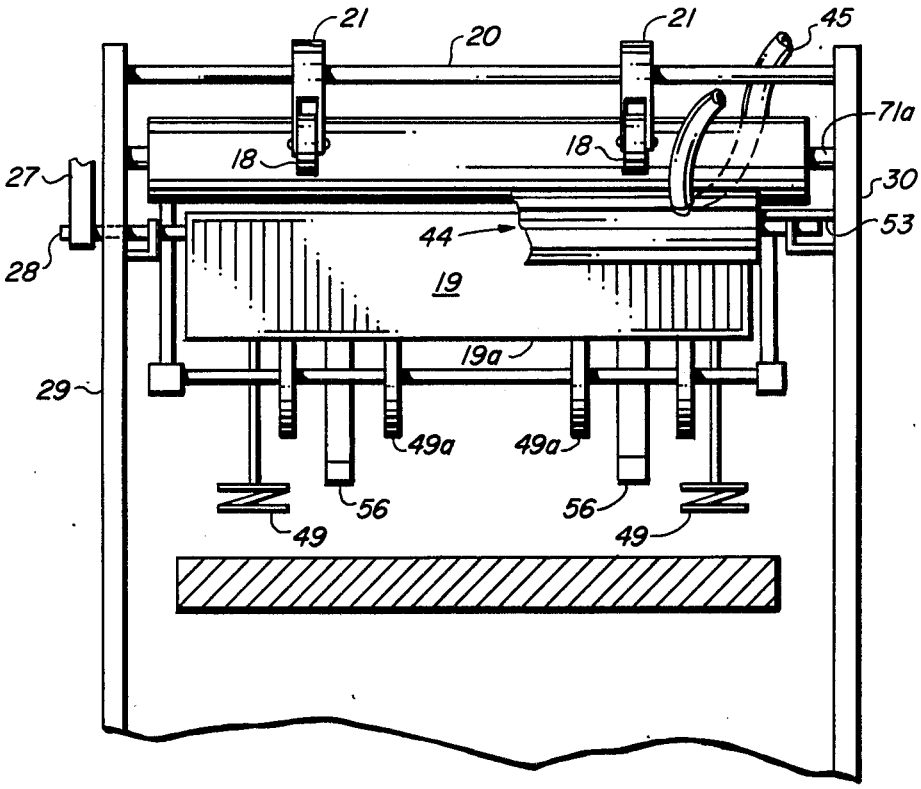
FIG. 5 is a front view of a portion of the spiral paper folding machine of FIG. 1 further showing the integration of the airstream apparatus of the invention with the chute and distributing rollers.

Briefly, in accordance with the presently preferred embodiment of the invention, I provide airstream apparatus in combination with a continuous form stationery machine for folding a strip of paper along transverse lines of weakening formed therealong. The continuous form stationery folding machine includes a frame, means mounted on the frame for alternately distributing successive lines of weakening in the paper in substantially opposite directions, roller means for continuously dispensing the strip of paper into the distributing means, and means carried by the frame for urging the distributed paper into a folded condition. The airstream apparatus comprises means for contacting the strip of paper from the roller means with at least one airstream dispensed generally flowing in the direction of travel of the dispensed paper. The airstream assists the movement and facilitates the distribution and folding of the paper and allows utilization of the continuous form stationery folding machine at higher operational speeds.

Turning now to the drawings which, for illustrative purposes depict the presently preferred embodiments of the invention and in which like reference characters identify corresponding parts in the several views, FIG. 1 is a perspective view showing the general arrangement of the elements of a spiral paper folding machine including the presently preferred embodiment of the airstream apparatus of the instant invention. A frame consisting of horizontal members 11 and vertical members 12 supports conveying unit 13 and various paper folding mechanisms which will be subsequently described. If desired, the frame 11–12 may be further provided with suitable supporting legs and associated horizontal bracing members mounted on casters to raise the entire apparatus to a convenient working height and to provide for moving the machine within a work area.

A continuous strip of paper or other material is drawn by dispensing roller 7 beneath roller guides 18 and directed into chute 19. Dispensing roller 17 is carried on axle 71*a* (not visible in FIG. 1) journalled for rotation in panels 29 and 30. The axle is rotated by the gear train of the apparatus. Roller guides 18 are secured to rod 20 by sleeves 21 provided with axles 22.

A pair of drive shafts 23*a* and 23*b* are integrated with the differential mechanism which is generally indicated by reference character 24. Shaft 23*b* rotates gear 25 in the direction of arrow A causing link 26 to reciprocate arm 27 in the directions of arrows B. Arm 27 is fixedly secured to shaft 28 which is attached to chute 19 and journalled for rotation in panel 29. An identical shaft 28 is affixed to the opposite side of chute 19 and is journalled for rotation in panel 30.

Transverse lines of weakening along material entering chute 19 are distributed in substantially opposite directions as chute 19 oscillates and, as later described, the material is compressed and folded by "beaters" and "spirals" (not visible in FIG. 1). Continuous moving belts 32 carried by roller 33 carry the folded paper away from the folding mechanisms in the direction of arrow C. The slope of conveyor table 13 is adjusted by turning handle 34.

Threaded shafts 38*a* and 38*b* each carry a sprocket 37 which engages continuous chain 36. By turning handle 35 shaft 38*a* is rotated causing the teeth of sprocket 37 to engage and turn continuous chain 36 so that sprocket 37 and shaft 38*b* simultaneously rotate. Rotation of shafts 38*a* and 38*b* horizontally adjusts the positions of the beaters, spirals and paper stops (not visible).

Differential mechanism 24 includes handle 40 for rotating shaft 41 which is provided with worm gear 41*a* engaging ring gear 42 fixedly attached to spider 43. As would be apparent to those skilled in the art, handle 40 may be turned while drive shafts 23*a* and 23*b* are rotated or are motionless so that the position of a particular point on shaft 23*b* may be rotated in relation to a point on shaft 23*b*. When handle 40 is not used to adjust the relative position of shafts 23*a* and 23*b*, the differential functions as an idler, allowing each shaft to turn at identical rpm.

The upper portion of chute 19 is provided with a collar 44 having air conduits 45 attached thereto. As shown in FIG. 2, the collar 44 is comprised of two generally C-shaped panel members 46 joined together at either end by generally circular panel members 47. Rectangular opening 44*a* receives paper dispensed by roller 17. Panel members 46 are provided with depending outwardly projecting orifices 48 which receive air conduits 45 extending from the impellor pump (not visible in FIGS. 1 and 2). The lower lip 46*a* of each member 46 is attached to one side of chute 19.

FIGS. 3–7 illustrate the interrelation of the chute 19, beaters 49*a*, spirals 49 and the airstream apparatus of the invention. The elastic flaps 46*a* of collar 44 are attached to chute 19 by rivets 51 and to panel members 46 by fasteners 52. Rods 53 secure collar 44 to panel members 29 and 30.

As shown in FIG. 6 belt 70 from power means (not shown) which drive the gear train actuates gear 71. Continuous belts 72 and 73 transmit power to impellor 74 through pulley gear 75. Motive power from gear 71 is transmitted through sector gears 78, 79 and 80 to removable toothed gear 81. Gear 80 is attached to plate 82 which has slot 83 formed therein and is rotatably mounted on rod 85. In order to remove gear 81 from shaft 23*a*, set screw 84 in slot 83 is loosened and gear 80 upwardly raised in the direction of arrow D. The size of gear 81 used to rotate shaft 23*a* depends on the distance between successive lines of weakening in the particular paper being folded. Air conduits 45 are attached to impellor 74 by friction fitting the ends of conduits 45 to the four depending upwardly projecting members 45*a*. During operation of the continuous form folding machine, impellor 74 generates air flow in the direction of arrows E.

In an alternate embodiment of the invention, depicted in FIGS. 8 and 9, air conduits 45 are provided with Y orifices 54 which discharge streams of air in the direction of arrows E onto the upper surface of paper distributed by chute 19. The air flowing from orifices 54 assists the foldig and compacting of the paper as well as aiding in pulling paper from chute 19 during the oscillation thereof.

In operation, as illustrated in FIG. 3, paper 50 dispensed from roller 17 enters rectangular opening 49 and downwardly travels through collar 44 and chute 19. Chute 19 distributes paper 50 in a zig-zag fashion while spirals 49 and beaters 49*a* fold the paper forming creases 55. At high operational speeds, chute 19 may be elastically distorted, particularly at the furtherest extreme of its travel where the chute must decelerate, stop and accelerate in the opposite direction. Distortion of the chute hinders passage of paper through the chute. Directing air flow from orifices 48 through the chute assists paper flow and allows the paper folding machine to be utilized at higher operational speeds. In preliminary tests with the preferred embodiment of the invention, 10–15% increases in the maximum operating speed of the spiral paper folding machine have been achieved.

Air flowing through the mouth of chute 19 aids in the compacting and folding of paper by spirals 49 and beaters 49*a* and reduces the force with which the creased edges 55 are "thrown" against paper stops 56. This minimizes crumpling of edges 55 on striking paper stops 56.

A standard chute 19 is provided with open ribbed sides which allow air entering collar 44 to escape through the sides of the chute before reaching mouth 19*a* of the chute. Although contacting paper passing through such a chute with air flow in the general direction of travel of the paper would result in an increase in the maximum operational speed of the paper folding machine, in order to optimize the assisting effect of the laminar flow of air along the surface of paper 50, chute 19 should, as shown in FIG. 3, be constructed with continuous panel sides.

The impellor 74 is connected to the drive train of the paper folding machine so that as the operational speed of the machine increases, there is a concomitant rise in the rate of air flow through conduits 45 into collar 44. In addition to providing this automatic throttling function, connecting the impellor directly to the paper folding machine drive train eliminates the necessity of a separate power system to provide motive power for the impellor.

As would be apparent to those skilled in the art, the configuration and number of orifices 48, 54 may be varied in consideration of the economics and optimal operating conditions required in each particular paper folding machine. For instance, in FIGS. 1–5, it might be desirable to provide an elongate rectangular opening similar to opening 44*a* in place of the two relatively small orifices 48 on either side of collar 44.

Having described my invention in such terms as to enable those persons skilled in the art to which it pertains to understand and practice it, and having identified the presently preferred embodiment thereof,

I claim:

1. Apparatus for producing and delivering continuous form stationery by folding a strip of paper along transverse lines of weakening formed therealong, said apparatus including (a) a frame;

(b) means comprising an oscillating chute having a mouth and mounted on said frame for alternately distributing at least some of said lines of weakening in said paper strip through said mouth in substantially opposite directions;

(c) roller means mounted on said frame for continuously feeding and dispensing said strip of paper into said oscillating chute, said paper strip traveling through said chute and said mouth of said chute to be distributed and folded in a zig-zag fashion;

(d) folding means carried on said frame and operatively associated with said oscillating chute for receiving and urging said paper strip distributed by said chute into a folded condition, said folding means including (i) means comprising spirals shaped and dimensioned to receive and carry away from said oscillating chute creased edges of said paper distributed through said mouth of said chute, (ii) beaters for periodically tamping said paper strip distributed through said mouth of said chute, said beaters assisting in the folding and positioning of said paper strip;

(e) means comprising a support surface carried on said frame for receiving paper dispensed by said beaters and spirals;

(f) orifice means mounted on said frame for directing at least one stream of air into said chute to flow through said chute in a direction of travel generally parallel to the direction of travel of said paper strip through said oscillating chute, said air stream (i) contacting said strip of paper when said strip passes through said chute, (ii) exiting through said mouth of said chute with said strip of paper, and (iii) assisting the movement and facilitating the distribution and zig-zag folding of said paper strip along said transverse lines of weakening therein and allowing utilization of said continuous form stationery folding apparatus at higher operational speeds; and, (g) means operatively associated with and connected to said orifice means for delivering to said orifice means air under pressure to be directed by said orifice means into said chute.

* * * * *